United States Patent [19]

Taga

[11] Patent Number: 4,616,954

[45] Date of Patent: Oct. 14, 1986

[54] CONTINUOUS PAVEMENT PROCESS FOR A BRIDGE SURFACE EXPANSION JOINT

[75] Inventor: Kazumitsu Taga, Kawasaki, Japan

[73] Assignee: Japan Constec Kabushiki Kaisha, Tokyo, Japan

[21] Appl. No.: 677,679

[22] Filed: Nov. 30, 1984

[30] Foreign Application Priority Data

Jul. 30, 1984 [JP] Japan ..... 59-157677

[51] Int. Cl.[4] ..... E01C 11/02

[52] U.S. Cl. ..... 404/74; 14/16.5; 14/73; 404/57; 403/364; 52/396

[58] Field of Search ..... 404/47, 53, 56, 57, 404/58, 60, 67, 68, 69, 50, 74; 14/73, 16.5, 1; 52/396, 573; 403/364, 28; 104/118; 238/228, 8

[56] References Cited

U.S. PATENT DOCUMENTS 3,838,931 10/1974 Vallá ..... 404/69

4,015,302 4/1977 Clark ..... 14/16.5

OTHER PUBLICATIONS

Watson, Steward "Zero Maintenance Expansion Joints & Bearings" (Watson Bowman Assoc.) 8-1978, pp. 22-24.

*Primary Examiner*—James A. Leppink

*Assistant Examiner*—Matthew Smith

*Attorney, Agent, or Firm*—Wenderoth, Lind & Ponack

[57] ABSTRACT

An improved continuous pavement process for a bridge surface comprises the steps of arraying a plurality of bridging metals in a hollow space provided between adjacent floor slabs of a bridge. Each of the plurality of bridging metals comprises a generally U-shaped member, which extends in the direction of a longitudinal bridge axis with its tip end opened and includes pieces being bent 180° and extending outside from the upper edges of the base portions of the respective side pieces thereof so as to form an inverse U-shaped cross-section jointly with the corresponding side piece, in such manner that a side piece of the generally U-shaped member of one of adjacent bridging metals may loosely and movably fit in the inverse U-shaped cross-section of the other bridging metal. Thereafter, the improved process comprises the further steps of fixedly securing base end portions of alternate ones of the arrayed bridging metals to the corresponding one of the adjacent floor slabs, then filling the hollow space with an asphalt mixture, and subsequently depositing an asphalt mixture surface layer over the above-described asphalt mixture and the respective floor slabs so as to be freely slidable.

4 Claims, 10 Drawing Figures

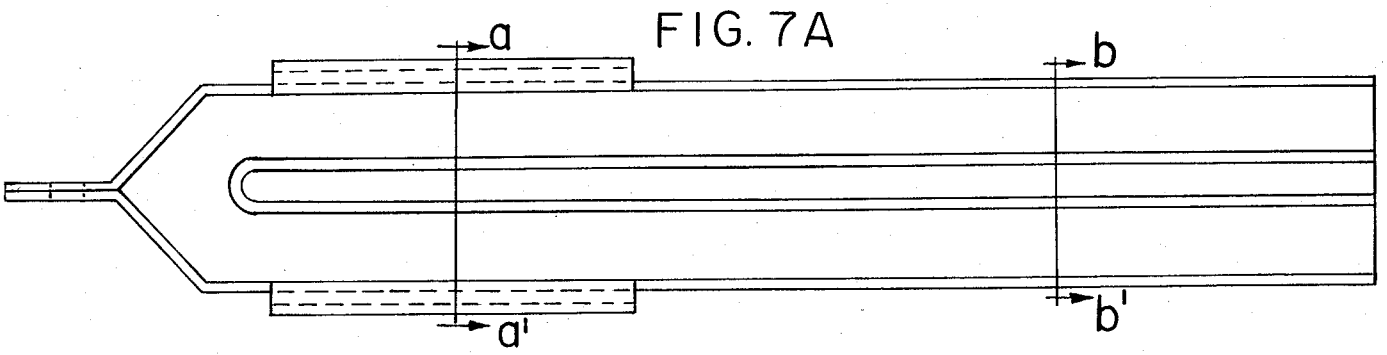
FIG. 7A
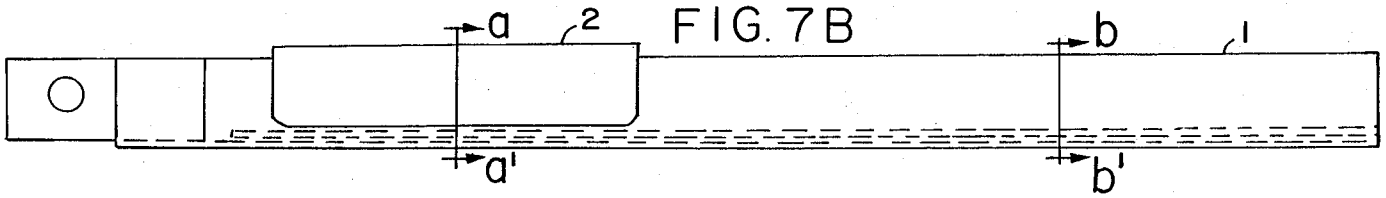
FIG. 7B
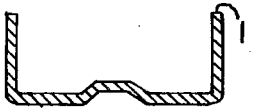
FIG. 9 b-b' SECTION
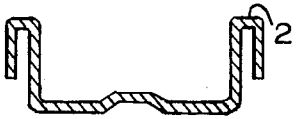
FIG. 8 a-a' SECTION

CONTINUOUS PAVEMENT PROCESS FOR A BRIDGE SURFACE EXPANSION JOINT

BACKGROUND OF THE INVENTION

1. Field of the Invention

The present invention relates to a continuous pavement process for constructing a bridge.

2. Description of the Prior Art

Bridges being built currently have a construction such that a girder, a floor slab and a bridge surface pavement are built in an integral structure for each section of a bridge between supports therefor, the end portions of the adjacent sections are connected to each other via an expansion joint, and the expansion joint itself is also used as a part of a bridge surface, that is, a surface over which vehicle wheels run.

Since a bridge would expand and contract as influenced by a temperature variation, creep of a material, contraction due to drying, etc., an expansion-admitting hollow space is an absolutely necessary requirement for a bridge structure, and in order to smoothen running of a vehicle thereover, in that hollow space, there is mounted an expansion joint which becomes the weakest point of the bridge structure.

Thus, a pavement of a bridge surface having an asphalt mixture is made to be discontinuous by the expansion joint, but on the other hand, continuity of a bridge surface is retained by the same expansion joint. Accordingly, as the brige surface in the prior art is made of a combination of an elastic body consisting of an asphalt mixture and a rigid body consisting of an expansion joint, in the event that the bridge surface pavement which is essentially the elastic body should be deformed by a load of wheels, the load of wheels would directly act upon the expansion joint which is essentially a rigid body, while such rigid body is also being hit by impacts.

Heretofore, within the above-mentioned expansion-admitting hollow space, there was disposed a bridging plate formed in a single structure. However, if a single structure such as the bridging plate is used in the hollow space which is subjected to various complex movements and a local loading, then local bending and deformation would arise in the bridging plate, hence it becomes unable to achieve the function of a bridging plate, and it becomes a source of noises and vibrations.

The present invention has been proposed on the basis of the recognition that the biggest cause for bringing about damages to a bridge surface in the prior art is that the bridge surface consists of a combination of an elastic body and a rigid body.

SUMMARY OF THE INVENTION

It is therefore one object of the present invention to provide a novel continuous pavement process for building a bridge surface in which a structure having flexibility and being adapted to various movements can be formed in the expansion-admitting hollow space provided between adjacent floor slabs of the bridge.

According to one feature of the present invention, there is provided a continuous pavement process for building a bridge surface including the steps of arraying a plurality of bridging metals in a hollow space provided between adjacent floor slabs of a bridge. Each of the plurality of bridging metals comprises a generally U-shaped member, which extends in the direction of a longitudinal brige axis with its tip end opened and includes pieces being bent 180° and extending outside from the upper edges of the base portions of the respective side pieces thereof so as to form an inverse U-shaped cross-section jointly with the corresponding side piece, in such a manner that a side piece of the generally U-shaped member of one of adjacent bridging metals may loosely and movably fit in the inverse U-shaped cross-section of the other bridging metal. Thereafter, the process includes the further steps of fixedly securing base end portions of alternate ones of the arrayed bridging metals to the corresponding one of the adjacent floor slabs, then filling the hollow space with as asphalt mixture, and subsequently depositing an asphalt mixture surface layer over the asphalt mixture and the respective floor slabs so as to be freely slidable.

According to the present invention, since a plurality of bridging metals each comprises a generally U-shaped member, which extends in the direction of a longiudinal bridge axis with its tip end opened and includes pieces being bent 180° and extending outside from the upper edges of the base portions of the respective side pieces thereof so as to form an inverse U-shaped cross-section jointly with the corresponding side piece, in such manner that a side piece of the generally U-shaped member of one of adjacent bridging metals may loosely and movably fit in the inverse U-shaped cross-section of the other bridging metal as described above, the assembly, consisting of two groups of the bridging metals directed in the opposite directions and being movable relative to each other, forms a structure which is expansible and contractible in the direction of the longitudinal bridge axis and is deformable in the direction at right angles to the longitudinal bridge axis.

Moreover, according to the present invention, since the hollow space, located between the adjacent floor slabs in which the above-described bridging metals are arrayed, is filled with an asphalt mixture, in the event that a bridge should expand or contract as a result of a temperature variation, the above-described bridging metal assembly would contract or expand, respectively, in the direction of the longitudinal bridge axis, and in response to a structural displacement in the widthwise direction of the bridge, the above-described respective groups of bridging metals would rotate relative to each other in the widthwise direction of the bridge. As a result, the relative displacement of the respective sections of the bridge structure can be absorbed by the expansion joint disposed in the hollow space provided between the adjacent floor slabs, and also, rupture of the expansion joint can be prevented.

The above-mentioned and other objects, features and advantages of the present invention will become more apparent by reference to the following description of a preferred embodiment of the invention taken in conjuction with the accompanying drawings.

BRIEF DESCRIPTION OF THE DRAWINGS

FIGS. 7A and 7B are top plan and side views, respectively, of the bridging metal shown in FIG. 3, and FIGS. 8 and 9 are cross-sectional views through lines a—a' and b—b', respectively, of FIGS. 7A and 7B.

DETAILED DESCRIPTION OF THE PREFERRED EMBODIMENT

Figure 1:
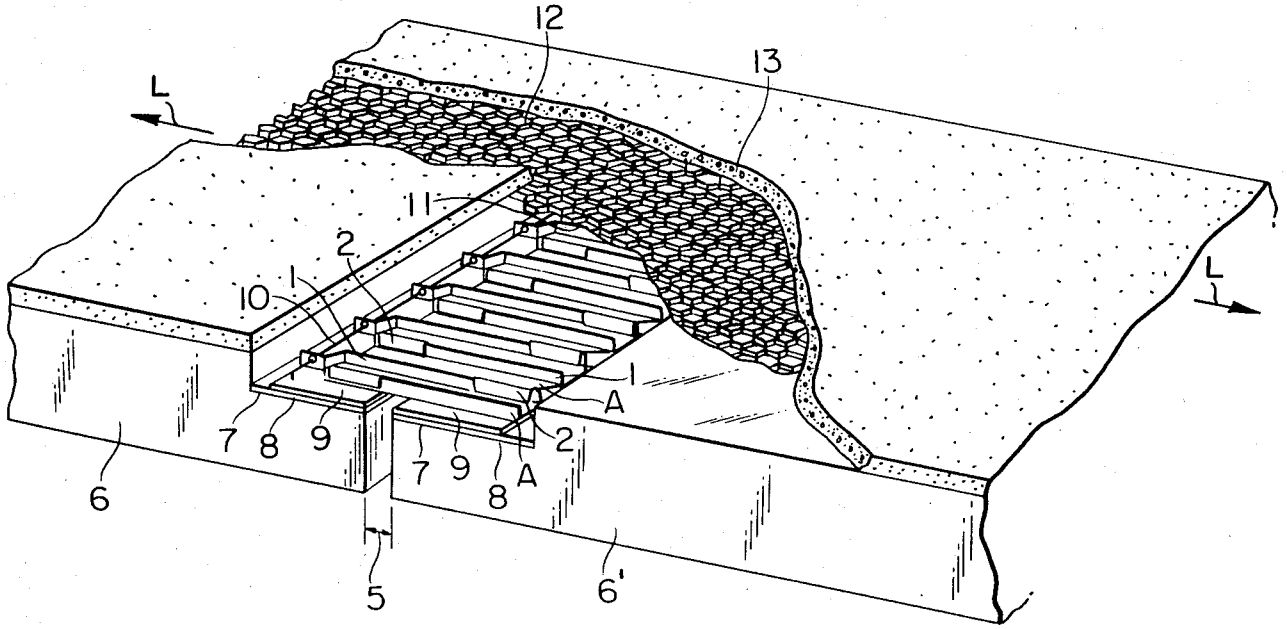
FIG. 1 is a perspective view partly cut away of a portion of a bridge built by practicing a continuous pavement process of constructing a bridge surface according to the present invention.
Figure 2:
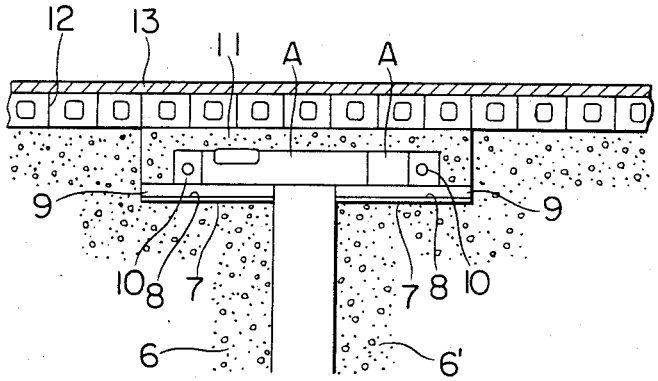
FIG. 2 is a longitudinal cross-sectional view of the portion of the bridge shown in FIG. 1.
Figure 3:
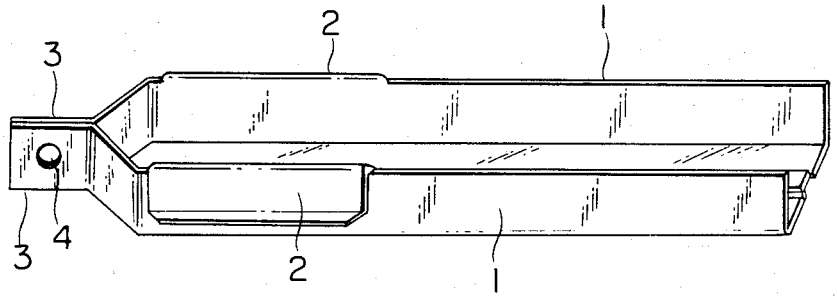
FIG. 3 is a perspective view of a bridging metal included in an expansion joint used in the structure shown in FIGS. 1 and 2, FIGS. 4 to 6 are perspective views showing different states of relative displacement of the bridging metals forming the expansion joint.

Now the present invention will be described in greater detail in connection with the illustrated embodiment. In the drawings, reference character (A) designates a bridging metal. As best shown in FIG. 3, the bridging metal consists of a generally U-shaped bottomed member having its tip end opened and including pieces (2) being bent at 180° and extending outside from the upper edges of the base portions of opposed side pieces (1) thereof so as to form an inverse U-shaped cross-section jointly with the piece (2). The base end portions of the opposed side pieces (1) are formed into overlapped vertical pieces (3), and a through-hole (4) is drilled in the vertical pieces (3).

On the upper surfaces of the opposed end portions of adjacent concrete floor slabs (6) and (6'), there are provided cut-away steps (7) so as to form an expansion-admitting hollow space (5). Flattening mortar layers (8) are applied onto the steps (7), and felt mats (9) impregnated with asphalt are laid thereon. Then the above-described bridging metals (A) are arrayed on the felt mats (9) in the direction at right angles to a longitudinal bridge axis (L) as directed alternately in the opposite directions in parallel to the bridge axis (L) in such manner that a side piece (1) of the generally U-shaped bottomed member of one of adjacent bridging metals (A) may loosely and movably fit in the inverse U-shaped cross-section of the other bridging metal (A). Thereafter horizontal reinforcing bars (10) are inserted through the through-holes (4) in the respective vertical pieces (3) of the respective group of bridging metals (A) on the respective side and are welded to reinforcing bars within the respective concrete floor slabs (6) and (6'). In this way, the bridging metals (A) are respectively fixedly secured to the concrete floor slab (6) or (6') by the intermediary of the reinforcing bars (10).

It is to be noted that, at the time point of the fixing work for the bridging metals (A), the ambient temperature under the working condition is measured, and taking into account the highest and lowest ambient temperature to which the bridge is to be exposed, the relative positioning of the two groups of bridging metals is adjusted and then fixed so as to admit the possible maximum expansion and contraction.

After the bridging metals (A) have been disposed in the above-described manner, an asphalt mixture (11) is filled in the cut-away steps (7) of the concrete floor slabs (6) and (6'). Then the upper surface of the asphalt mixture (11) is finished to be flush with the upper surface of the concrete floor slabs (6) and (6') by sufficiently rolling the surface to form an expansion joint. Thereafter the upper surfaces of the asphalt mixture (11) and the concrete floor slabs (6) and (6') are covered with a fabric impregnated with asphalt (not shown), and on the fabric, there is slidably laid an asphalt pavement (13) in which a reinforcing wire netting (12) is buried, so that expansion and contraction of the bridge can be absorbed by sliding movement of the asphalt pavement (13).

It is to be noted that, in the illustrated embodiment, the wire netting (12) is formed of a netting consisting of an assembly of hexagonal cyclinders in a honeycomb shape.

Figure 4:
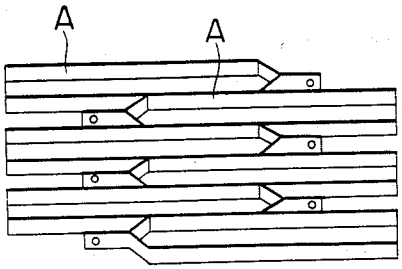
Figure 6:
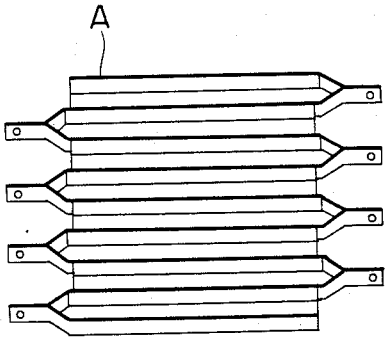

Since the assembly of the bridging metals (A), consisting of two groups of bridging metals (A) directed in opposite directions to each other, is expansible and contractible in the longitudical direction of the bridge axis (L), when the hollow space (5) between the adjacent floor slabs (6) and (6') has been reduced as a result of a temperature rise, the respective groups of bridging metals (A) would slide in the direction of the bridge axis (L) so as to approach each other as shown in FIG. 4 (relative to the neutral positions shown in FIG. 6). Hence, the asphalt mixture (11), containing voids therein and thus having a large viscoelasticlity, which has been filled in the hollow space (5), is compressed and reduced in volume.

Figure 5:
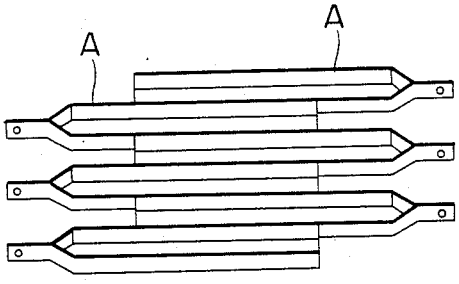

On the other hand, if the hollow space (5) between the adjacent floor slabs (6) and (6') should extend due to influence of a temperature fall upon the bridge, then the respective groups of bridging metals (A) would slide in the direction of the bridge axis (L) so as to separate from each other as shown in FIG. 5 (relative to the neutral positions shown in FIG. 6). Hence, the volume of the asphalt mixture (11) increases following the expansion of the assembly of the bridging metals (A), resulting in dispersed voids within the asphalt mixture (11).

In this way, following the expansion and contraction of the bridge, the assembly of the bridging metals (A) disposed within the cut-away steps (7) of the floor slabs (6) and (6') would contract and expand, respectively. Also, the volume of the ashpalt mixture (11) within the above-mentioned cut-away steps (7) would vary, and thereby rupture of the expansion joint can be prevented.

In addition, when a force directed in the transverse direction for the bridge axis has been exerted upon the bridge, owing to the fact that the side piece (1) of the generally U-shaped bottomed member in each bridging metal (A) is loosely and movably fitted in the inverse U-shaped cross-section formed by the bent piece (2) and the side piece (1) of the adjacent bridging metal (A), the adjacent bridging metals (A) can rotate relative to each other in the direction perpendicular to the longitudinal bridge axis. Hence, the force directed in the transverse direction for the bridge axis can be absorbed, and thereby rupture of the expansion joint can be prevented.

While the present invention has been described above in connection with one preferred embodiment of the invention, as a matter of course, it is intended that the present invention should not be limited to only such embodiment but many changes and modifications in design could be made without departing from the spirit of the present invention.

What is claimed is:

1. A process for constructing a continuous pavement on a bridge surface, comprising the steps of:

arraying a pluality of bridging metals so that U-shaped members thereof are positioned with bent pieces thereof alternately overlapping in a hollow space provided between adjacent floor slabs of a bridge;

securing fixedly base end portions of alternate ones of the arrayed bridging metals to a corresponding one of the adjacent floor slabs;

filling the hollow space with an asphalt mixture; and depositing subsequently a continuous asphalt mixture surface layer over the asphalt mixture and over the floor slabs;

whereby the floor slabs are freely slidable toward and away from each other under the continuous asphalt mixture surface layer.

2. The process according to claim 1, wherein:

each of the plurality of bridging metals has its U-shaped member extending parallel to a longitudinal axis of the bridge with a tip end open.

3. The process according to claim 2, wherein:

each of the plurality of bridging metals has its bent pieces extending outside from upper edges of base portions of side pieces thereof so as to form an inverse U-shaped cross-section jointly with a corresponding side piece of another bridging metal.

4. The process according to claim 3, wherein:

sides pieces of the U-shaped members of each of the adjacent bridging metals loosely and movably fit in the inverse U-shaped cross-section of another bridging metal.

* * * * *